US010077143B2

(12) United States Patent
Roth et al.

(10) Patent No.: US 10,077,143 B2
(45) Date of Patent: Sep. 18, 2018

(54) LID FOR CONTAINER WITH ROTATABLE RECLOSABLE SPOUT

(71) Applicant: Cool Gear International, LLC, Plymouth, MA (US)

(72) Inventors: Donna Roth, Duxbury, MA (US); Marcus Hanna, Stamford, CT (US)

(73) Assignee: Cool Gear International, LLC, Plymouth, MA (US)

( * ) Notice: Subject to any disclaimer, the term of this patent is extended or adjusted under 35 U.S.C. 154(b) by 0 days.

(21) Appl. No.: 15/307,975

(22) PCT Filed: May 13, 2015

(86) PCT No.: PCT/US2015/030666
§ 371 (c)(1),
(2) Date: Oct. 31, 2016

(87) PCT Pub. No.: WO2015/175723
PCT Pub. Date: Nov. 19, 2015

(65) Prior Publication Data

US 2017/0050776 A1 Feb. 23, 2017

Related U.S. Application Data

(60) Provisional application No. 61/992,789, filed on May 13, 2014.

(51) Int. Cl.
*B67B 1/00* (2006.01)
*B65D 47/24* (2006.01)
(Continued)

(52) U.S. Cl.
CPC ..... *B65D 47/244* (2013.01); *B65D 1/023* (2013.01); *B65D 53/02* (2013.01)

(58) Field of Classification Search
CPC ..... B65D 50/045
(Continued)

(56) References Cited

U.S. PATENT DOCUMENTS 5,111,977 A 5/1992 Maguire et al.
5,429,282 A 7/1995 Stebick
(Continued)

FOREIGN PATENT DOCUMENTS

JP 08-244822 A 9/1996
JP 2003-267417 A 9/2003
RU 2494940 C1 10/2013

OTHER PUBLICATIONS

The Written Opinion issued in corresponding International Application No. PCT/US2015/030666, dated Aug. 12, 2015, 6 pages.
(Continued)

*Primary Examiner* — Lori Baker
(74) *Attorney, Agent, or Firm* — Mintz Levin Cohn Ferris Glovsky and Popeo, P.C.; Steven M. Jensen

(57) ABSTRACT

A lid connected to a container or body portion of a bottle includes a base defining a conduit, where a rotatable collar coupled to the base rotates about the conduit in a single direction. The lid further includes a spout having a cam defining a path on the outer surface of the spout that engages at least a portion of the collar when the rotatable collar rotates about the conduit. The spout can extend away from the base into an open position and retract proximate to the base into a closed position as the portion of the collar traverses the path defined by the cam when the rotatable collar is rotated about the conduit.

20 Claims, 6 Drawing Sheets

(51) Int. Cl.
*B65D 1/02* (2006.01)
*B65D 53/02* (2006.01)

(58) Field of Classification Search
USPC .. 222/153.14, 109, 513, 507, 514, 521–525, 222/541.6; 215/230, 388, 252; 446/74
See application file for complete search history.

(56) References Cited

U.S. PATENT DOCUMENTS

| | | | |
|---|---|---|---|
| 5,431,305 | A | 7/1995 | Kaminski |
| 5,588,562 | A | 12/1996 | Sander et al. |
| 5,713,493 | A | 2/1998 | Garibaldi |
| 2004/0116036 | A1 | 6/2004 | Nugent et al. |
| 2006/0196894 | A1 | 9/2006 | Lindsay |
| 2011/0049195 | A1 | 3/2011 | Russell et al. |

OTHER PUBLICATIONS

Supplementary European Search Report dated Sep. 20, 2017 in corresponding European Application No. 15 79 2473.

LID FOR CONTAINER WITH ROTATABLE RECLOSABLE SPOUT

CROSS REFERENCE TO RELATED APPLICATIONS

This application is the U.S. national stage pursuant to 35 U.S.C. § 371, of United States International Application Ser. No. PCT/US2015/030666, filed May 13, 2015 and published in English on Nov. 19, 2015 as publication WO2015/175723 A1, which claims priority to and the benefit of U.S. Application Ser. No. 61/992,789, filed May 13, 2014, the full disclosures of which are hereby incorporated by reference herein for all purposes.

FIELD OF THE INVENTION

The present invention relates to container caps, and more particularly, to container caps with sealing or closing mechanisms.

BACKGROUND

Some conventional drink bottles or containers that house water or other potable beverages may include a lid. Lids may include various spouts, nozzles, or openings to fit, for example, a tube or straw that allows users to consume or drink liquids contained within the bottle without removing the lid.

Generally, containers (e.g., sports containers) include a cap that has a mechanism for opening and closing the cap to selectively control when fluid can enter and/or exit the container (e.g., a screw on cap, a flip cap, etc.). Generally, to access the fluid within the container, a spout must be moved relative to or removed from a lid of the container so that a fluid path into the container can be accessed. However, such access, at times, can prove difficult if the spout is fixed too tightly to the lid. Additionally, constantly touching the spout can be unsanitary, since after touching the spout, the spout often comes into contact with a person's mouth. Accordingly, solutions for providing improved lids are needed.

SUMMARY OF THE INVENTION

One aspect of the invention provides a lid having a base defining a conduit (e.g., defining a path for fluid flow there-through) and configured to engage a container (e.g., a bottle, a container, etc.). The lid includes a rotatable collar coupled to the base, which is configured to rotate about the conduit in a single direction, and a spout. The spout has a cam defining a path on the outer surface of the spout that engages at least a portion of the rotatable collar when the rotatable collar rotates about the conduit. Operatively, the spout is configured to extend away from the base into an open position and retract proximate to the base into a closed position as the portion of the rotatable collar traverses the path defined by the cam when the rotatable collar is rotated about the conduit.

In certain embodiments, the spout is biased away from the base (e.g., by a spring, flex tube, etc.). Additionally, the cam defining the path on the outer surface of the spout can include, for example, a helical incline plane, a ramp, a channel, or the like.

In other embodiments, the lid further includes one or more tabs in communication with the base and the rotatable collar. In such embodiments the one or more tabs indicate when the spout is in the open position, or the closed position, and/or releasably prevent the rotatable collar from rotating about the conduit. The rotatable collar can likewise include one or more detents that releasably engage the one or more tabs to operatively releasably prevent the rotatable collar from rotating about the conduit.

In additional embodiments, a portion of the base that defines the conduit is releasably removable from the base (e.g., for washing, changing, etc.).

In still further embodiments, the invention provides a bottle including a housing that defines the bottle and is configured to hold a volume of liquid. The housing including a neck portion that engages with a lid. The lid includes a base defining a conduit, which base is particularly configured to engage the neck portion of the housing. The lid also includes a rotatable collar coupled to the base and a spout. The rotatable collar is configured to rotate about the conduit in a single direction and includes at least one projection extending inwardly toward the conduit. The spout has a cam defined on its outer surface. The cam engages the projection of the rotatable collar and defines a path for the projection when the rotatable collar rotates about the conduit. Operatively, the spout is configured to extend away from the base into an open position and retract proximate to the base into a closed position as the projection of the rotatable collar traverses the path defined by the cam.

These and other features of the lid of the subject invention will become more readily apparent to those skilled in the art from the following detailed description of the various embodiments taken in conjunction with the drawings.

BRIEF DESCRIPTION OF THE DRAWINGS

The embodiments herein may be better understood by referring to the following description in conjunction with the accompanying drawings in which like reference numerals indicate identically or functionally similar elements, of which.

DETAILED DESCRIPTION OF THE INVENTION

The instant invention is most clearly understood with reference to the following definitions:

As used in the specification and claims, the singular form "a," "an," and "the" include plural references unless the context clearly dictates otherwise.

As used in the specification and claims, the terms "comprises," "comprising," "containing," "having," and the like can have the meaning ascribed to them in U.S. patent law and can mean "includes," "including," and the like.

Unless specifically stated or obvious from context, as used herein, the term "or" is understood to be inclusive.

Figure 1:
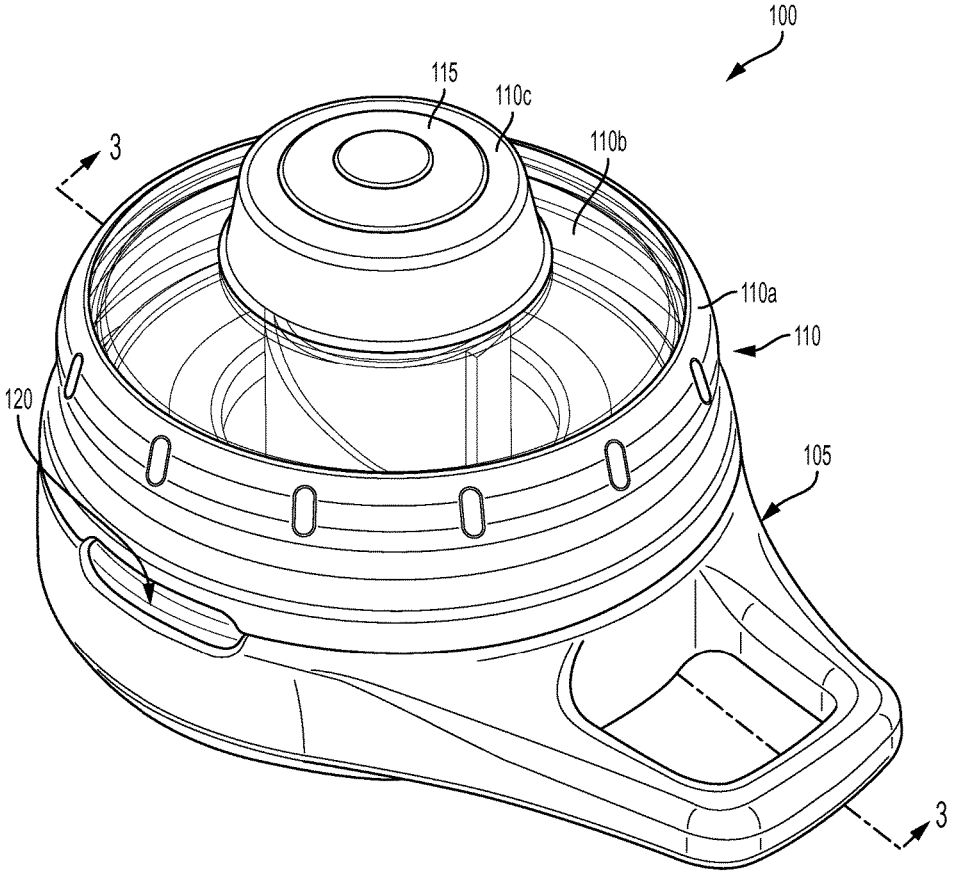
FIG. 1 is a perspective view of a lid according to one exemplary embodiment of the present invention, showing the lid in a closed position.

Various aspects of the invention provide lids and containers. Reference will now be made to the drawings wherein like reference numerals identify similar structural features or aspects of the subject invention. For purposes of explanation and illustration, and not limitation, a perspective view of an exemplary embodiment of a lid in accordance with the invention is shown in FIG. 1 and is designated generally by reference character 100. Other aspects of the lid are provided in FIGS. 2-13, as will be described herein. The lids of this invention can be used in with various containers, bottles, canisters, or other suitable applications.

As shown in FIG. 1, a lid 100 may include a base 105, which may be coupled to a container (not shown), which may be sized to hold a volume of liquid. As shown, lid 100 also includes a rotatable collar 110 and a spout 115. Notably, the rotatable collar 110 may include various sub-components such as an outer housing 110*a*, an inner housing 110*b* (shown as transparent) and a cap or guard 110*c*. The lid 100 also includes one or more tabs 120 positioned between and engaging with the base 105 and the rotatable collar 110.

Figure 2:
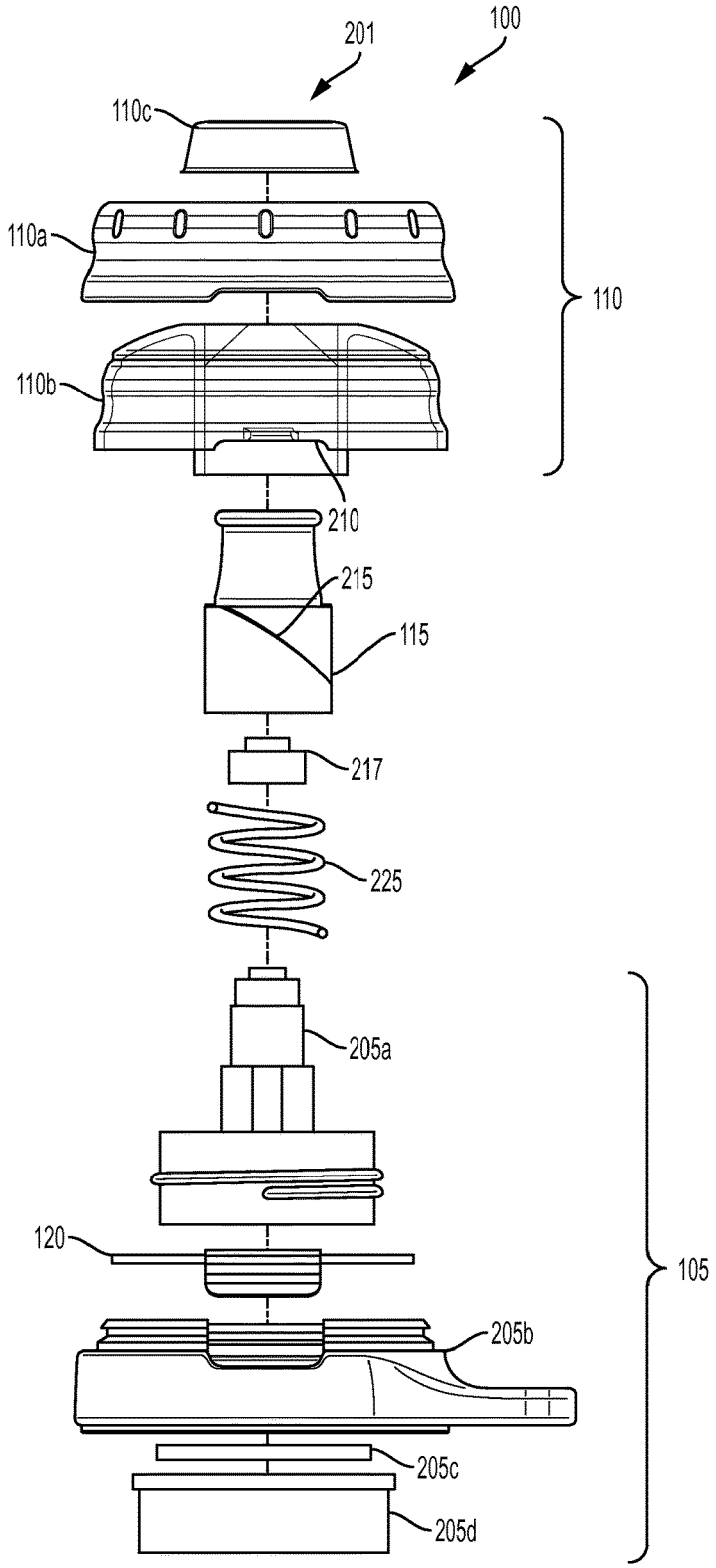
FIG. 2 is an exploded perspective view of the exemplary lid shown in FIG. 1.

Referring to FIG. 2, components of the lid 100 are shown in an exploded side-elevation view. Each of the components may be individually constructed (e.g., via known molding techniques, etc.), constructed in various combinations, or constructed as a one piece design (e.g., via 3-D printing or other similar molding techniques). For example, as discussed above, the rotatable collar 110 may include an assembly of sub-components (e.g., the inner housing 110*b*, the outer housing 110*a*, the cap or guard 110*c*, and the like). Similarly, the base 105 also includes various sub-components (denoted by reference numbers 205*a*-205*d*) including an inner housing 205*a* defining a conduit, an outer base housing 205*b* that couples to the rotatable collar 110, one or more gasket(s) 205*c*, and a secondary inner housing 205*d* that couples to a container or bottle. One or more of these sub-components may be releasably engaged with the base assembly to facilitate removal for cleaning, changing out parts, and the like.

As shown in FIG. 2, for example, the spout 115 preferably includes a cam 215 that defines a path on an outer surface of the spout 115. As provided in this exemplary embodiment, the cam 215 is a helical incline plane, but it is appreciated that various other types of cam shapes can be used such as a channel, a ramp, a helical ramp and the like.

Still referring to FIG. 2, the lid 100 also includes a spring 225 that engages with the spout 115 and biases the spout 115 to an open position, and one or more gaskets 217 are positioned between the spout 115 and the spring 225.

In operation, the rotatable collar 110 rotates about a conduit 201 to open and close the lid 100. As the rotatable collar 110 rotates about the conduit 201, the rotatable collar 110 engages with the spout 115. In particular, a portion of the rotatable collar 110 such as a projection, a boss, protuberance, and the like, engages with the cam 215. When the rotatable collar 110 rotates, the projection traverses the path defined by the cam 215 to cause the spout 115 to extend away from the base 105 into an open position and/or retract proximate to the base 105 into a closed position. Preferably, the path defined by the cam 215 is symmetrical such that the rotatable collar rotates in a single direction to cause the spout 115 to extend into the open position and retract to the closed position.

Additionally, a tab 120 (shown as an included part of the base assembly) engages with corresponding inlaid or inset portions (e.g., grooves) of the outer base housing 205*b* as well as with one or more detents 210 of the rotatable collar 110 to releasably secure the spout 115 in the open or the closed position by releasably preventing the rotatable collar 110 from rotating about the conduit 201.

As discussed above, the spring 225 engages with the spout 115 and biases the spout 115 to an open position to facilitate continuous engagement of the cam 215 with the portion of rotatable collar 110. In certain embodiments, the spring 225 is optional (e.g., when the cam 215 is configured as a channel with a corresponding mating configuration on the rotatable collar 110, etc.).

Figure 3:
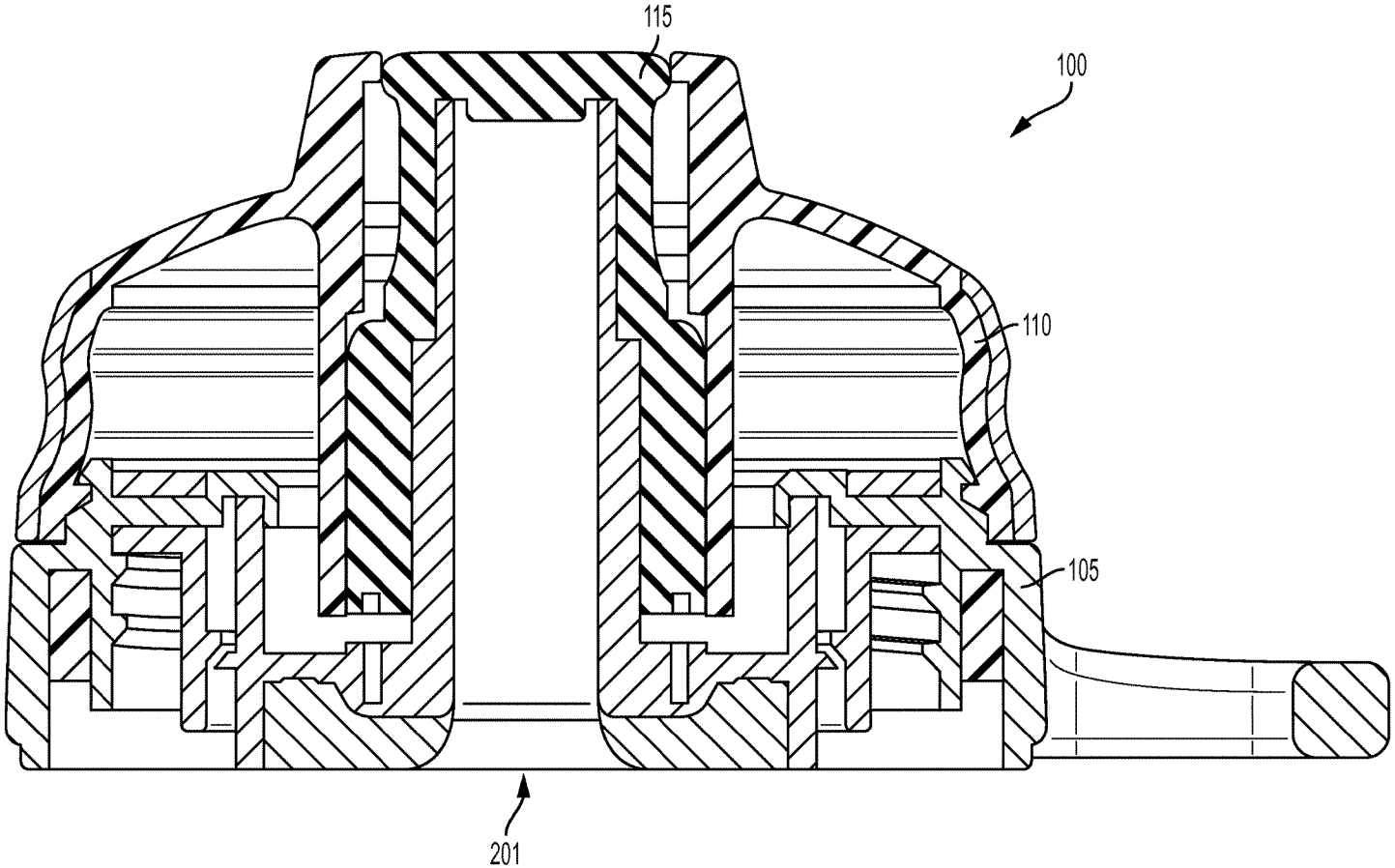
FIG. 3 is a cross-sectional side elevation view of the lid taken at cut lines 3-3 of FIG. 1.

Referring to FIG. 3, a cross-sectional side elevation view of the lid 100 is shown from the perspective of cut lines 3-3 of FIG. 1. FIG. 3 particularly illustrates the cooperation and communication of the various components of the lid 100, including: the base 105, the rotatable collar 110, and the spout 115.

Figure 4:
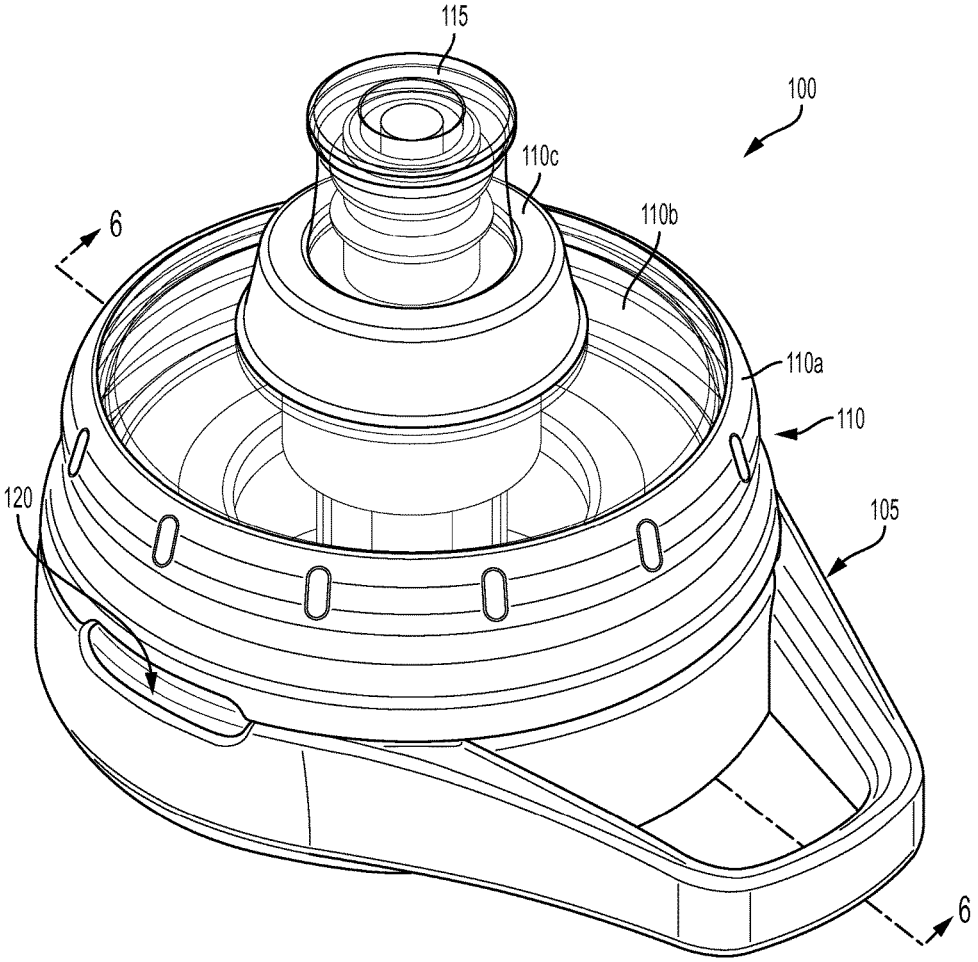
FIG. 4 a perspective view of a lid according to another exemplary embodiment of the present invention, showing the lid in a closed position.

FIG. 4 depicts an alternate embodiment of lid 100 in which spout 115 is configured in a different manner, although the structure of rotatable collar 110 may be configured in the same general manner as the lid shown in FIG. 1.

Figure 5:
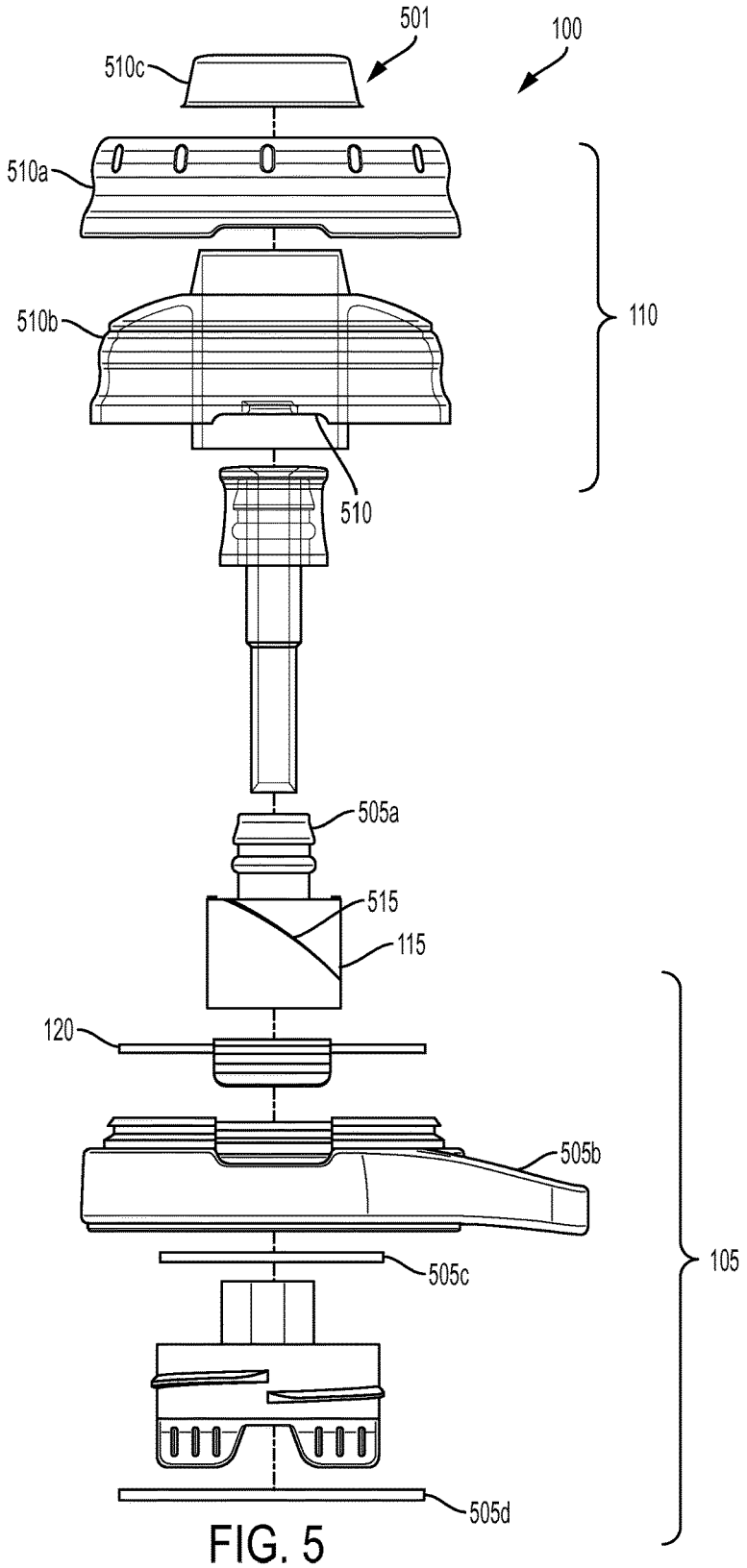
FIG. 5 is an exploded perspective view of the exemplary lid shown in FIG. 4.
Figure 6:
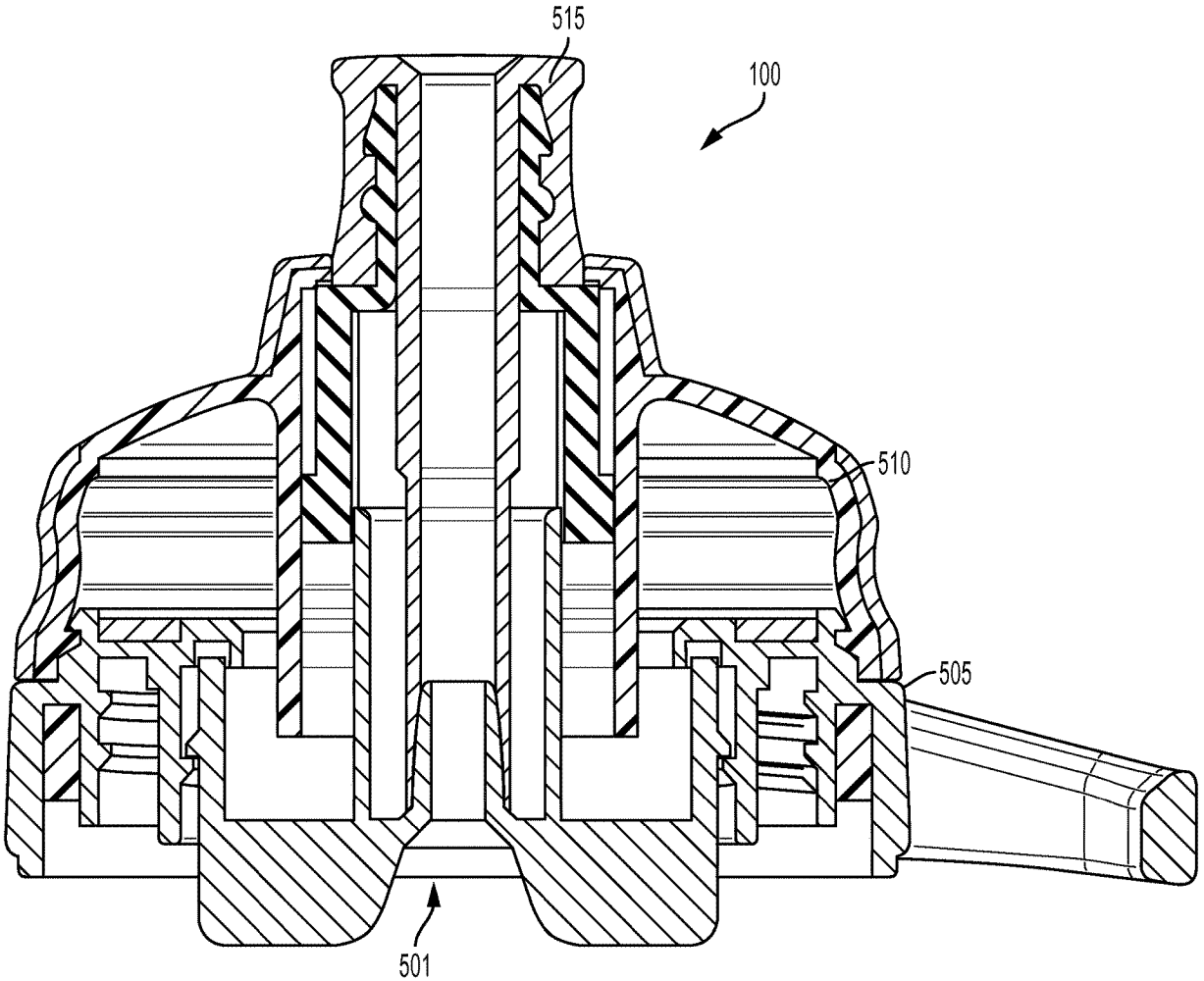
FIG. 6 is a cross-sectional side elevation view of the lid taken at cut lines 6 of FIG. 4.

Referring to FIG. 5, components of the lid 100 are shown in an exploded side-elevation view. Each of the components may be individually constructed (e.g., via known molding techniques, etc.), constructed in various combinations, or constructed as a one piece design (e.g., via 3-D printing or other similar molding techniques). For example, as discussed above, the rotatable collar 110 may include an assembly of sub-components (e.g., the inner housing 510*b*, the outer housing 510*a*, the cap or guard 510*c*, and the like). Similarly, the base 105 also includes various sub-components (denoted by reference numbers 505*a*-505*d*) including an inner housing 505*a* defining a conduit, an outer base housing 505*b* that couples to the rotatable collar 110, one or more gasket(s) 505*c*, and a secondary inner housing 505*d* that couples to a container or bottle. One or more of these sub-components may be releasably engaged with the base assembly to facilitate removal for cleaning, changing out parts, and the like.

As shown in FIG. 5, for example, the spout 115 preferably includes a cam 515 that defines a path on an outer surface of the spout 115. As provided in this exemplary embodiment, the cam 515 is a helical incline plane, but it is appreciated that various other types of cam shapes can be used such as a channel, a ramp, a helical ramp and the like.

Still referring to FIG. 5, the lid 100 also includes a spring 525 that engages with the spout 115 and biases the spout 115 to an open position.

In operation, the rotatable collar 110 rotates about a conduit 201 to open and close the lid 100. As the rotatable collar 110 rotates about the conduit 201, the rotatable collar 110 engages with the spout 115. In particular, a portion of the rotatable collar 110 such as a projection, a boss, protuberance, and the like, engages with the cam 515. When the rotatable collar 110 rotates, the projection traverses the path defined by the cam 515 to cause the spout 115 to extend away from the base 105 into an open position and/or retract proximate to the base 105 into a closed position. Preferably, the path defined by the cam 515 is symmetrical such that the rotatable collar rotates in a single direction to cause the spout 115 to extend into the open position and retract to the closed position.

Additionally, a tab 120 (shown as an included part of the base assembly) engages with corresponding inlaid or inset portions (e.g., grooves) of the outer base housing 505*b* as well as with one or more detents 510 of the rotatable collar 110 to releasably secure the spout 115 in the open or the closed position by releasably preventing the rotatable collar 110 from rotating about the conduit 201.

As discussed above, the spring 525 engages with the spout 115 and biases the spout 115 to an open position to facilitate continuous engagement of the cam 215 with the portion of rotatable collar 110. Spring 525 may be made of any suitable elastic material such as, for example, silicon. When spout 115 is in a closed position, spring 525 is compressed along a vertical axis.

The embodiments described herein and shown in the drawings, provide for a lid that can be opened and closed without needing to directly touch or contact the spout. In particular, a user can easily manipulate the rotatable collar 110 about the conduit 201 to cause the spout 115 to extend (i.e., open) or retract (i.e., close). While these embodiments have been described using specific terms, such description is for illustrative purposes only, and it is to be understood that changes and variations may be made without departing from the spirit or scope of the following claims.

While the disclosed embodiments have been described in detail, it will be appreciated by those skilled in the art that changes may be made in these embodiments without departing from the principles and spirit of the invention.

What is claimed is:

1. A lid comprising:

a base defining a conduit and configured to engage a container;

a rotatable collar coupled to the base and configured to rotate about the conduit in a single direction;

a spout having a cam defining a path on an outer surface of the spout that engages at least a portion of the rotatable collar when the rotatable collar rotates about the conduit, the spout configured to extend away from the base into an open position and retract proximate to the base into a closed position as the portion of the collar traverses the path defined by the cam when the rotatable collar is rotated about the conduit; and a spring in communication with the base and the spout, wherein the spring is biased toward the open position.

2. The lid of claim 1, wherein the spout is biased away from the base.

3. The lid of claim 1, further comprising:

one or more tabs in communication with the base and the rotatable collar, the one or more tabs indicating when the spout is in the open position or the closed position.

4. The lid of claim 3, wherein the one or more tabs are further configured to releasably prevent the rotatable collar from rotating about the conduit.

5. The lid of claim 3, wherein the rotatable collar includes one or more detents that releasable engage with the one or more tabs so as to releasably prevent the rotatable collar from rotating about the conduit.

6. The lid of claim 1, wherein a portion of the base that defines the conduit is releasably removable from the base.

7. The lid of claim 1, wherein the cam defining the path on the outer surface of the spout is a helical incline plane.

8. The lid of claim 1, wherein the cam defining the path on the outer surface of the spout is a channel.

9. The lid of claim 1, wherein the conduit defines a path for fluid flow there-through.

10. A bottle comprising:

a housing defining the bottle configured to hold a volume of liquid, the housing including a neck portion;

a lid comprising:

a base defining a conduit and configured to engage the neck portion of the housing;

a rotatable collar coupled to the base and configured to rotate about the conduit in a single direction, the rotatable collar having at least one projection extending inwardly toward the conduit; and a spout biased away from the base, the spout having a cam defined on an outer surface that engages the projection of the rotatable collar and defines a path for the projection when the rotatable collar rotates about the conduit, the spout configured to extend away from the base into an open position and retract proximate to the base into a closed position as the projection traverses the path of the cam.

11. The bottle of claim 10, further comprising:

a spring in communication with the base and the spout, wherein the spring is biased toward the open position.

12. A lid comprising:

a base defining a conduit and configured to engage a container;

a rotatable collar coupled to the base and configured to rotate about the conduit in a single direction; and a spout biased away from the base, the spout having a cam defining a path on an outer surface of the spout that engages at least a portion of the rotatable collar when the rotatable collar rotates about the conduit, the spout configured to extend away from the base into an open position and retract proximate to the base into a closed position as the portion of the collar traverses the path defined by the cam when the rotatable collar is rotated about the conduit.

13. The lid of claim 12, further comprising:

a spring in communication with the base and the spout, wherein the spring is biased toward the open position.

14. The lid of claim 12, further comprising:

one or more tabs in communication with the base and the rotatable collar, the one or more tabs indicating when the spout is in the open position or the closed position.

15. The lid of claim 14, wherein the one or more tabs are further configured to releasably prevent the rotatable collar from rotating about the conduit.

16. The lid of claim 14, wherein the rotatable collar includes one or more detents that releasable engage with the one or more tabs so as to releasably prevent the rotatable collar from rotating about the conduit.

17. The lid of claim 12, wherein a portion of the base that defines the conduit is releasably removable from the base.

18. The lid of claim 12, wherein the cam defining the path on the outer surface of the spout is a helical incline plane.

19. The lid of claim 12, wherein the cam defining the path on the outer surface of the spout is a channel.

20. The lid of claim 12, wherein the conduit defines a path for fluid flow there-through.

* * * * *